US005898943A

United States Patent [19]

Kim

[11] Patent Number: 5,898,943

[45] Date of Patent: May 4, 1999

[54] GOLF GLOVE

[75] Inventor: Jong Bok Kim, Seoul, Rep. of Korea

[73] Assignee: Kim, Jong Bok, Seoul, Rep. of Korea

[21] Appl. No.: 08/982,423

[22] Filed: Dec. 2, 1997

[30] Foreign Application Priority Data

Dec. 2, 1996 [KR] Rep. of Korea ..... 96-45054

[51] Int. Cl.[6] ..... A41D 19/00

[52] U.S. Cl. ..... 2/161.2; 2/161.4; 2/162

[58] Field of Search ..... 2/161.2, 161.3, 2/161.1, 20, 163, 159, 161.4, 162, 160, 917; 482/105, 44

[56] References Cited

U.S. PATENT DOCUMENTS

| | | | |
|---|---|---|---|
| 889,397 | 6/1908 | O'Shaughnessy | 2/161.2 |
| 2,083,935 | 6/1937 | Arnold | 2/159 |
| 2,980,915 | 4/1961 | Peterson | 2/159 |
| 3,597,765 | 8/1971 | Stanton | 2/161.3 |
| 4,751,749 | 6/1988 | Cowhey | 2/163.1 |
| 4,813,079 | 3/1989 | Reitzel | 2/161.2 |
| 4,911,433 | 3/1990 | Walker et al. | 2/161.1 |
| 5,453,064 | 9/1995 | Williams, Jr. | 2/161.1 |
| 5,683,335 | 11/1997 | Groves et al. | 482/105 |
| 5,704,883 | 1/1998 | Eckmann | 482/105 |
| 5,768,710 | 6/1998 | Williams | 2/161.2 |
| 5,820,526 | 10/1998 | Hoffman | 482/105 |

*Primary Examiner*—Amy B. Vanatta
*Attorney, Agent, or Firm*—Staas & Halsey

[57] ABSTRACT

The invention has as its purpose the provision of a golf glove contributing to improvement of the head speed and stable swing of the golf club. The golf club consists of weights equipped with two or more overlapping pieces on the glove surface of the back of the hand part and fingers. The golf glove can increase the head speed of the golf club, which increases the flying distance of the ball. It prevents the thigh's unnatural bending in advance, which makes for an ideal back swing, down swing and follow through. If a player is right-handed, it is expected that right hand needs less power to increase inertial mass of left hand wearing the glove and it is possible to prevent slicing of a ball caused by distributing more power to the right hand. The weights on the glove surface of the back of the hand part, which are disposed toward the wrist, lessen the inertial mass caused by hand's rotary motion in comparison to weights placed far from the wrist. Accordingly, this invented golf glove increases the whole inertial mass of an arm and a hand and prevents unnatural power from wrist and joints so that natural swing (back swing, down swing and follow through) could be possible.

6 Claims, 6 Drawing Sheets

GOLF GLOVE

FIELD OF THE INVENTION

The present invention is related to a golf glove worn when playing golf.

DESCRIPTION OF THE PRIOR ART

It is reported that existing golf gloves are mostly made of leather material to protect skin of the hand which holds the golf club and to make the glove fit tightly to a golf club, such gloves are equipped a pad to protect a palm of the hand and a leather string grip to hold a wrist band. The existing golf gloves ar expected to only protect the hand and to hold ?? the club. The gloves don't have active effects to enhance the scores, including head speed improvement and stable swing of golf club.

PROBLEMS TO BE SOLVED BY THE INVENTION

The invention has as its purpose the provision of a golf glove contributing to improvement of the head speed and stable swing of the golf club.

MEANS OF RESOLVING THE PROBLEMS

To achieve the purpose recited above, the golf glove by this invention is equipped at least one overlapping part. According to the golf of the present invention, first, in swinging of a golf club, it is expected to increase inertial mass in rotary movement of an arm and a hand centering at the shoulder. The increased inertial mass would improve speed of golf club head and tremendously lengthen flying distance of a ball.

Second, the increased inertial mass assures the stability of back swing, down swing and follow through, when swinging the golf club. That is, increased inertial mass works as forcing power and prevents the thigh's unnatural bending on swing. Accordingly, this makes for an ideal back swing, down swing and follow through, in which a club head makes a perfect half-circle.

Third, if a player is right-handed it is expected to have effect that right hand keeps less power to increase inertial mass of the left hand worn golf glove and it is possible to prevent slicing of the ball caused by distributing more power to the right hand.

Desirably, the weights are equipped on the glove surface covering both the back of the hand and any fingers.

By this, the glove can carry weight evenly dispersed without weight being focused at one spot. That is, a dispersed weight can maintain equalized weight of the glove. The glove keeps natural feeling of fit and, at the same time, does not interrupt the feeling of grip.

Desirably, the weights are provided at every glove surface of the side of the thumb, the back of the hand and the back of the index finger the middle finger, the third finger, and the little finger.

Overlaps are placed on the glove surface of both the back of the hand and fingers and existing weight in the palm of the hand holding the golf club is not influenced.

Desirably, the weight equipped on the glove surface on the back of the hand is placed toward the wrist. Weights on the glove surface of the back of the hand, which are located toward the wrist lessen the inertial mass caused by hand's rotary motion in comparison to overlaps placed far from the wrist. Accordingly, this golf glove increases inertial mass of the arm and hand and prevents unnatural power from the wrist and joints so that natural swing (back swing, down swing and follow through) are possible.

Desirably, aforementioned weights placed on the glove surface covering the index finger, the middle finger, the third finger, and the little finger ar placed at second joints and the weight equipped on the side of the thumb is placed at the first joint. That is, weights are centered on finger joints and do not interfere with the movement of bones.

Desirably, the weights on the surface of the back of the hand consist of two or more plate-shaped overlapping pieces. Accordingly, when the glove is worn, each weight piece is placed closely on curved surface of glove and does not interfere with the detailed movement of the hand bones. Even increased contact space holding the pieces closely on curved surface prevents glove from sliding off. Weights are contacted with curved surface of the back of the hand and that makes the existence of the weights hardly felt.

Desirably, the present invention, the golf glove is equipped with holding material to hold tightly and cover up the weights on the glove surface.

The holding material contacts the weights on the back of the hand and prevents shift of the central weight caused by the unstable weights. The close contact improves feelings and prevents the orbit of the accurate arc of the golf club head with natural movement of the arm in swing. In addition, covering up the existence of the weights by a holding material outside keeps up a user's dignity in the gently sports, such as golf.

Desirably, the glove surface on the back of the hand has a counter-surface, i.e. a palm of the hand, which contains anti-sliding equipment.

This device, increasing friction coefficient on the palm of the hand, assures gripping of golf club and prevents grip from sliding when increase inertial mass speeds up swing.

Desirably, the weights are easy to attach to and detach from the glove. In case iron is used as the weights, the weights can be rusted when water-washed. However, weights of present invention are easy to attach to and detach from the glove. The glove with weights detached can be water-washed. it is needless to say that water-washing of the glove is possible even though the weight is excessive.

Desirably, the weight may be altered. A purchaser can change the weight distribution on each part even after purchase.

As described below, the present invention, the golf glove, can increase the head speed of the golf club, which increases the flying distance of the ball. It prevents the thigh's unnatural bending in advance. This makes for an ideal back swing, down swing and follow through. If a player is right-handed, it is expected that right hand keeps less power to increase inertial mass of the left hand wearing the glove and it is possible to prevent slicing a ball caused by giving more power to the right hand.

The weights on the glove surface on the back of the hand part, which are disposed toward the wrist, lessen the inertial mass caused by the hand's rotary motion in comparison to weights placed far from the wrist. Accordingly, this invented golf glove increases the whole inertial mass of an arm and a hand and prevents unnatural power from wrist and joints so that a natural swing (back swing, down swing and follow through) could be possible.

BRIEF DESCRIPTION OF THE DRAWINGS

The invention will be described in greater details with reference to the drawings in which.

DETAILED DESCRIPTION OF THE INVENTION

Figure 1:
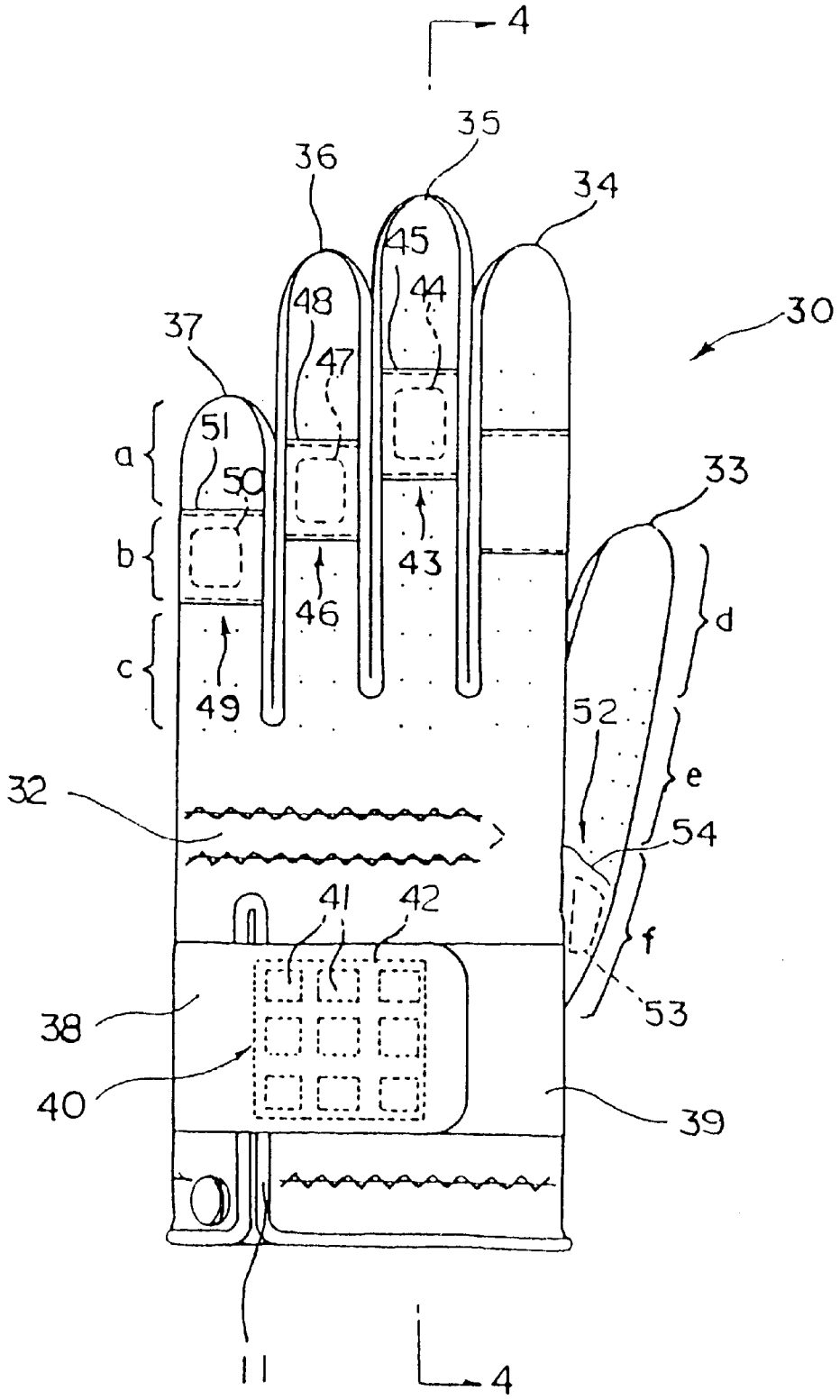
FIG. 1 is a top plan view showing a first embodiment of the present invention with weighted wrist bands.
Figure 6:
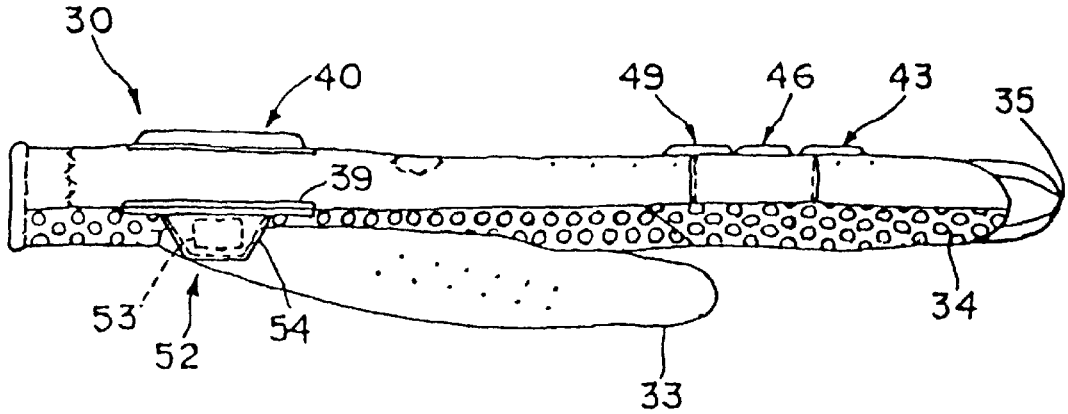
FIG. 6 is a side elevational view of golf glove of FIG. 2 and sows the thumb.

The first embodiment of the present invention, a golf glove, is shown in FIGS. 1 and 6. The embodiment of the present invention is a golf glove including the back of the hand part 32, the thumb part 33, the index finger part 34, the middle finger part 35, the third finger part 36 and the little finger part 37, which are made of treated and seamed leather.

Figure 4:
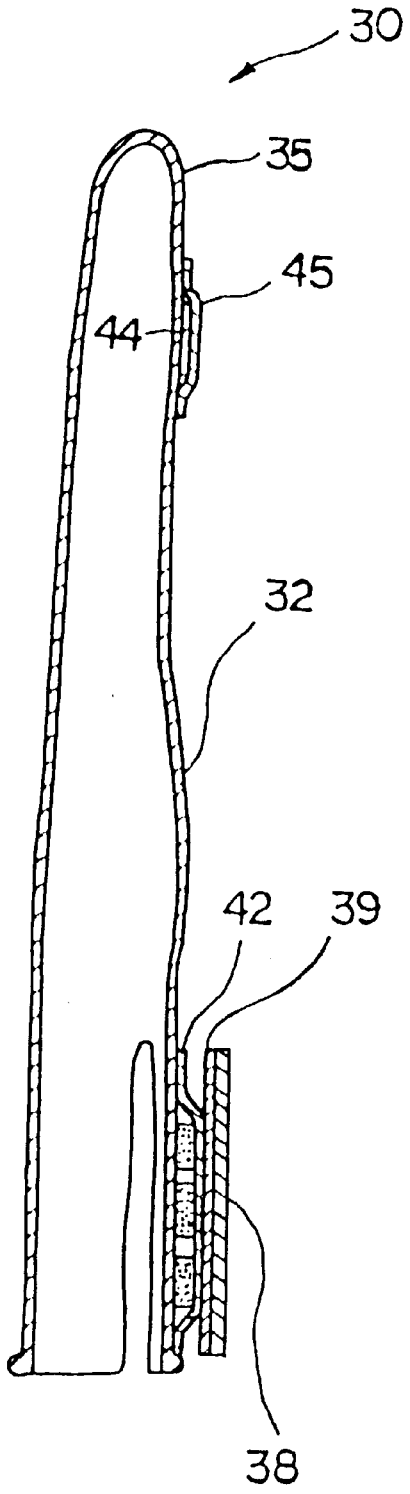
FIG. 4 is a cross-sectional view taken on the line 4—4 in FIG. 1.
Figure 5:
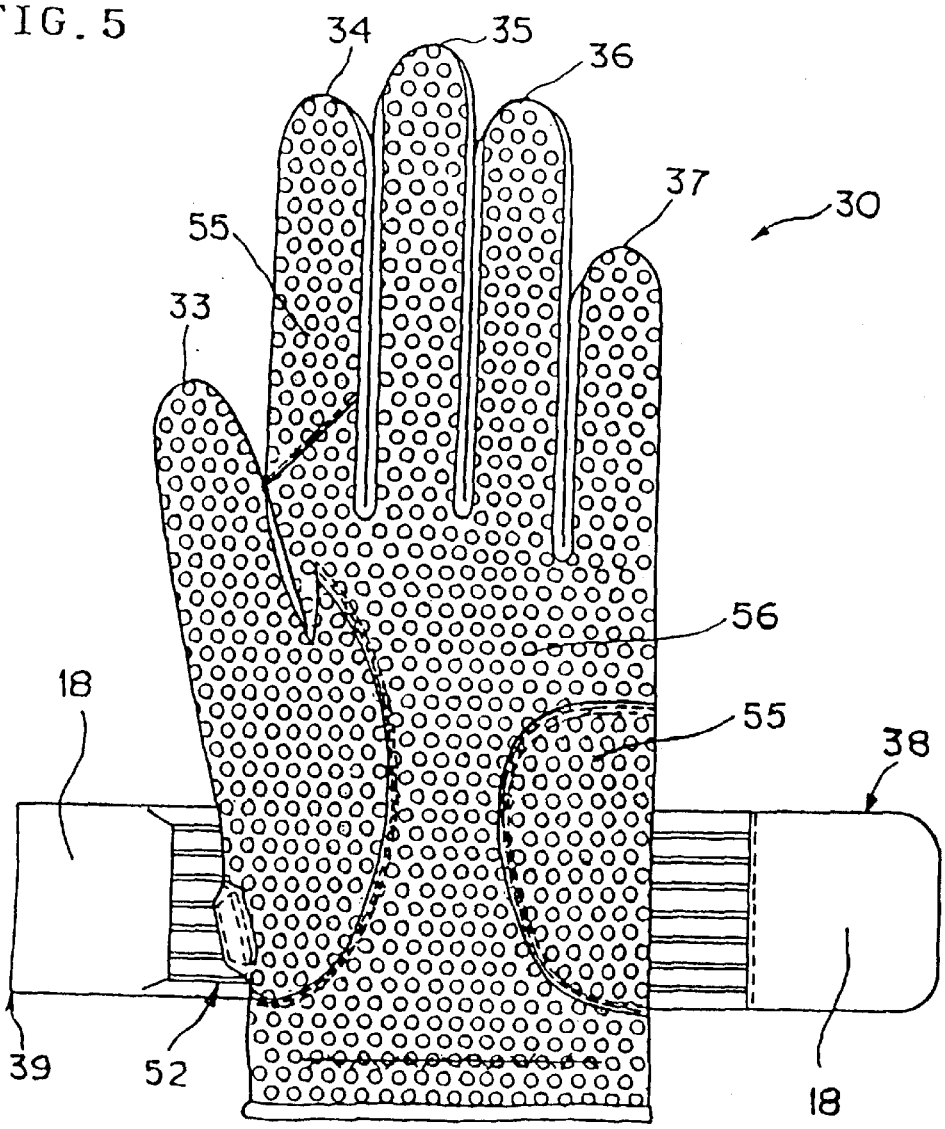
FIG. 5 is a bottom plan view showing a palm of a golf glove of FIG. 2.

As shown in FIG. 4 of cross-sectional view, piled part 40 on glove surface of the back of the hand is placed toward the wrist and the first wrist band 39 covers an upper part of surface of the back of the hand and the second wrist band covers them.

Overlapping part 40 on surface of the back of the hand consists of spherical plate-shaped weights 41 and covering material 42 which covers them. Square plate-shaped weights 41 are made of nine lead pieces attached to the glove surface of the back of the hand part in three rows of three keeping a little mutual space. The hem of covering material 40 is sewn on the glove surface of the back of the hand and weights 41 are fixed on the glove surface of the back of the hand.

The weights on the glove surface of the back of the hand, consist of plural weights, and are accompanied evenly on the curved surface of the hand when worn so that the widths do not interfere with the complicated movement of the hand bones. The weights placed close to one another decrease the space between the glove and skin surface of the back of the hand. That increases the contact area between the glove and a hand and this prevents the glove from sliding.

Figure 2:
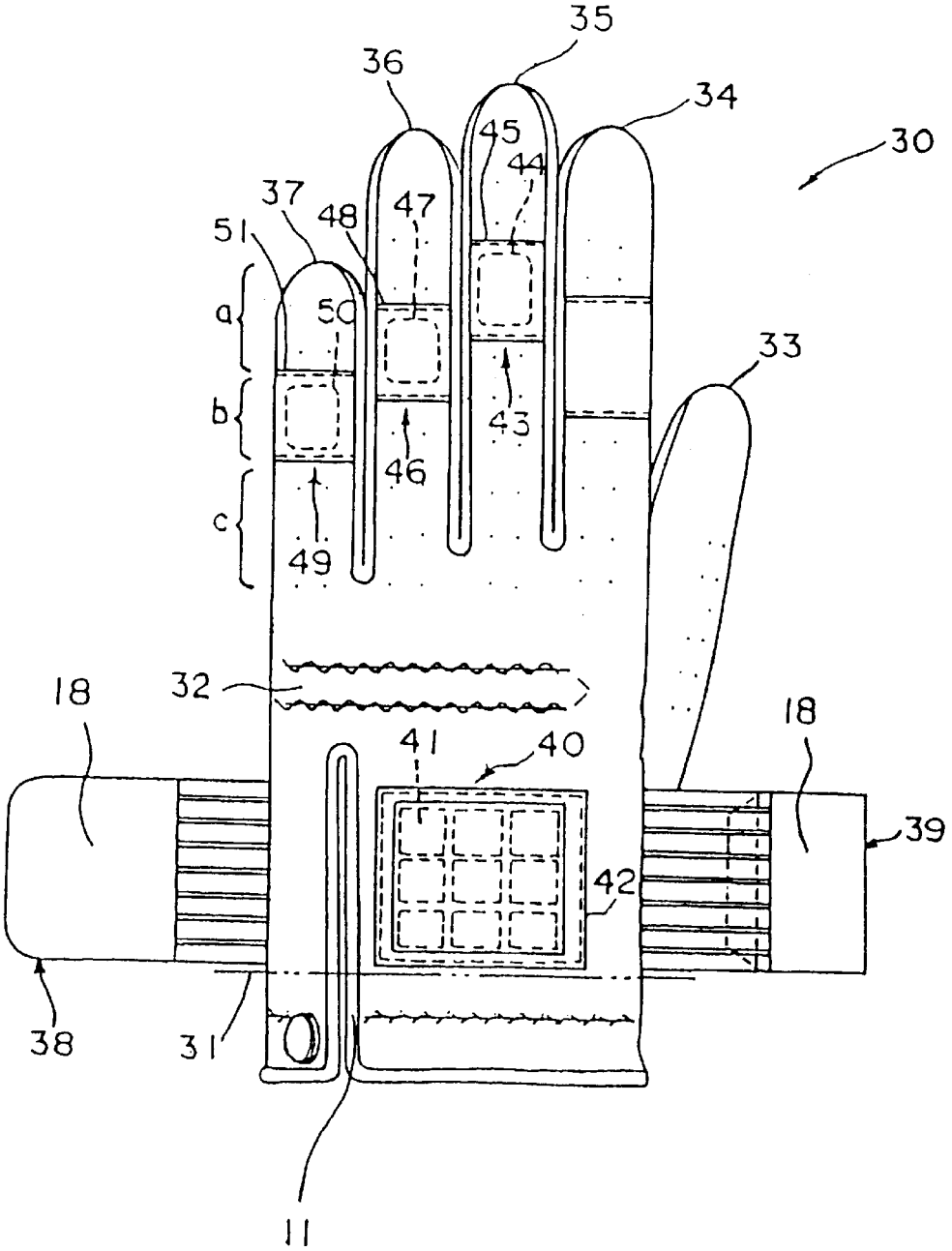
FIG. 2 is a top plan view of a golf glove with an open wrist band.

The overlap 40 on the surface of the back of the hand part 32 is disposed toward the wrist. That is, the edge of overlap 40 on the surface of the back of hand part is placed next to the wrist joint 31 as shown in FIG. 2.

This reduces inertial mass of the hand's rotary motion centering wrist joint region compared to placing the overlapped part 40 apart from the wrist. Even though the whole inertial mass of the arm and hand is increased, the wrist joint region can be prevented from unnatural power forced caused by the inertial force. That makes swing (back swing, down swing and follow through) natural.

More desirably, the weight of each weight 41 on surface of the back of the hand part is 11*g* and the total weight of weights 41 on the surface of the back of the hand part is 99*g*. However, the wight of the weights is not limited to this.

At the second segment b of the middle finger 35, one square plate-shaped lead weight 44 is placed with covering material 45 which covers the lead piece. The covering material 45 covering the weight 44 is fixed on the surface of the second segment of the middle finger by being sewn on the surface of the second segment of the middle finger on the side of the back of the hand. The same method applies to the third finger part 36 and the little finger apt 37. The weight 44 placed at the second segment of the fingers does not interfere with the movement between finger bones. The weight of the overlapped part 44, 47, 50 is desirably 7.5*g* but it is not limited to that weight.

Also, at the second segment f of the thumb part 33, the overlapped part 52 is placed. The overlapped part 52 consists of one square plate-shaped lead piece 53 and covering material 54 which covers the weight 53. The covering material 54 is sewn on the flank side of the second segment f of the thumb part 33 so that the weight 53 is fixed on the thumb part 33. The weight on the thumb part 33 is 4*g* but the weight is not limited to this amount.

Figure 3:
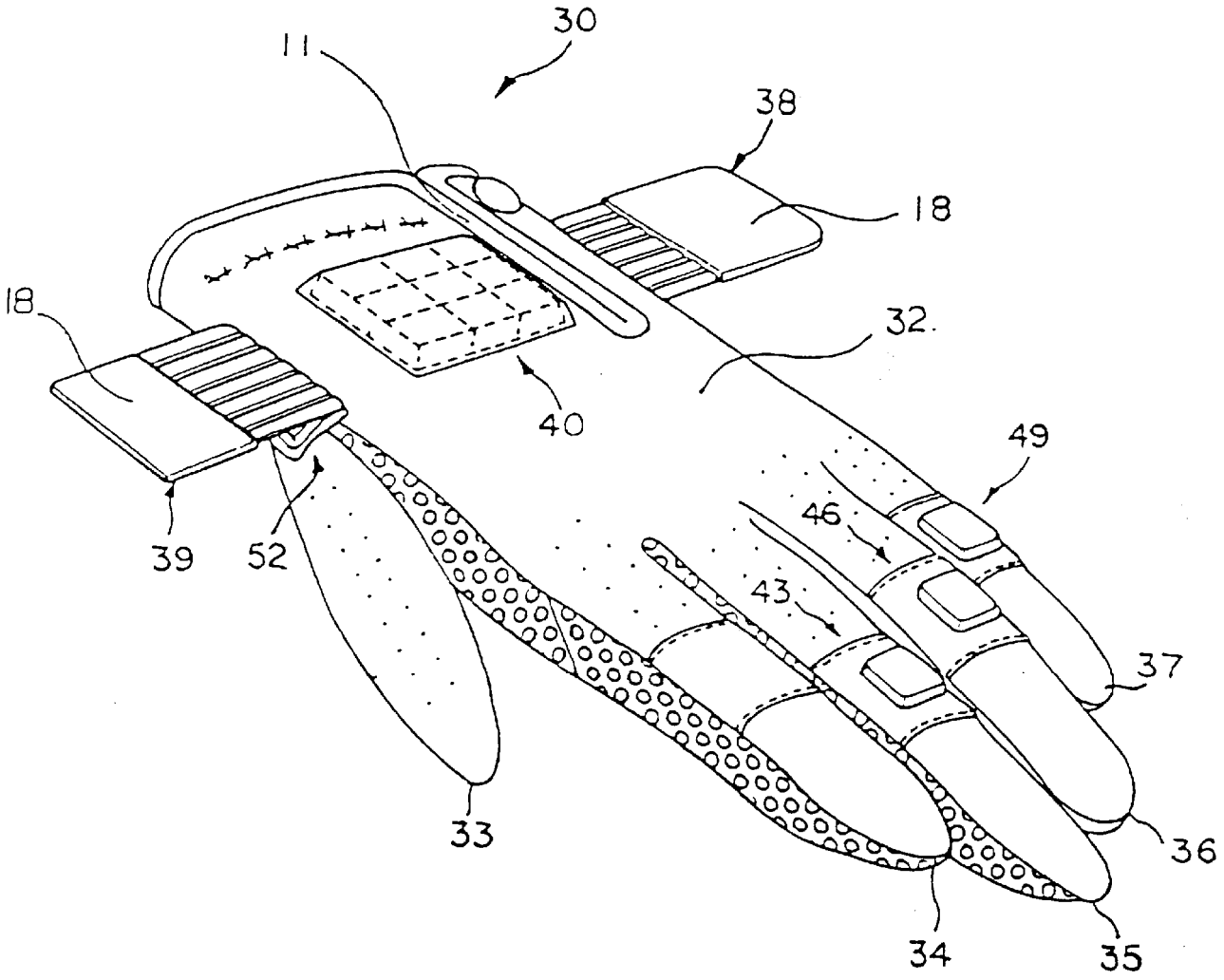
FIG. 3 is a perspective view of a golf glove of FIG. 2.

As shown in FIGS. 2 and 3, one of the wrist bands 39 is sewn on the flank side of a wrist and the other wrist band 38 is sewn on the other flank side of the wrist. Each of wrist bands 38, 39 is equipped with VELCRO™ tape 18, on one side. Pieces of the tape 18 make the wrist bands 38, 39 pile up one over the other. Therefore, when the wrist bands 38, 39 are joined together and the two pieces of the VELCRO tap 18 are stuck together, the wrist bands 38, 39 are tightened upon the wrist. Also, the width of the wrist bands 38, 39 is wider than the perpendicular width of the overlapped part 40 on the surface of the back of the hand to cover up completely the overlapped part 40.

Therefore, close contact is formed between the overlapped part 40 on the surface of the back of the hand and a wearer's surface skin of the back of the hand, which enhances feeling. The close contact prevents shift of the centroid caused by misplacing overlapped part 40. thus accurate orbit of the arc of the golf club head with natural movement of arm during the swing is maintained.

As shown in FIG. 6, on the glove surface of palm of the hand part, depressed engravings by dimple procedure and relieves by an embossing procedure are equipped for anti-sliding. The depressed engravings and embossed relieves increase the coefficient of friction, which enables the glove to hold the golf club tightly, and prevent golf club grip from sliding off caused by increased swing speed with increased inertial mass.

According to the aforementioned first embodiment of the present invention, in swinging a golf club, it is expected to increase inertial mass in rotary movement of an arm and a hand centering the shoulder. This increased inertial mass would improve club head speed of the golf club and tremendously lengthen flying distance of a ball.

Second, increased inertial mass assures the stability of the back swing down, swing, and follow through, in the swing of a golf club. That is, increased inertial mass works as forcing power to thigh's joint as the way to lengthen it and, in advance, prevents thigh's unnatural bending in swing. Accordingly, this makes for ideal back swing, down swing, and follow through, in which a club head makes a perfect half-circle.

Figure 7:
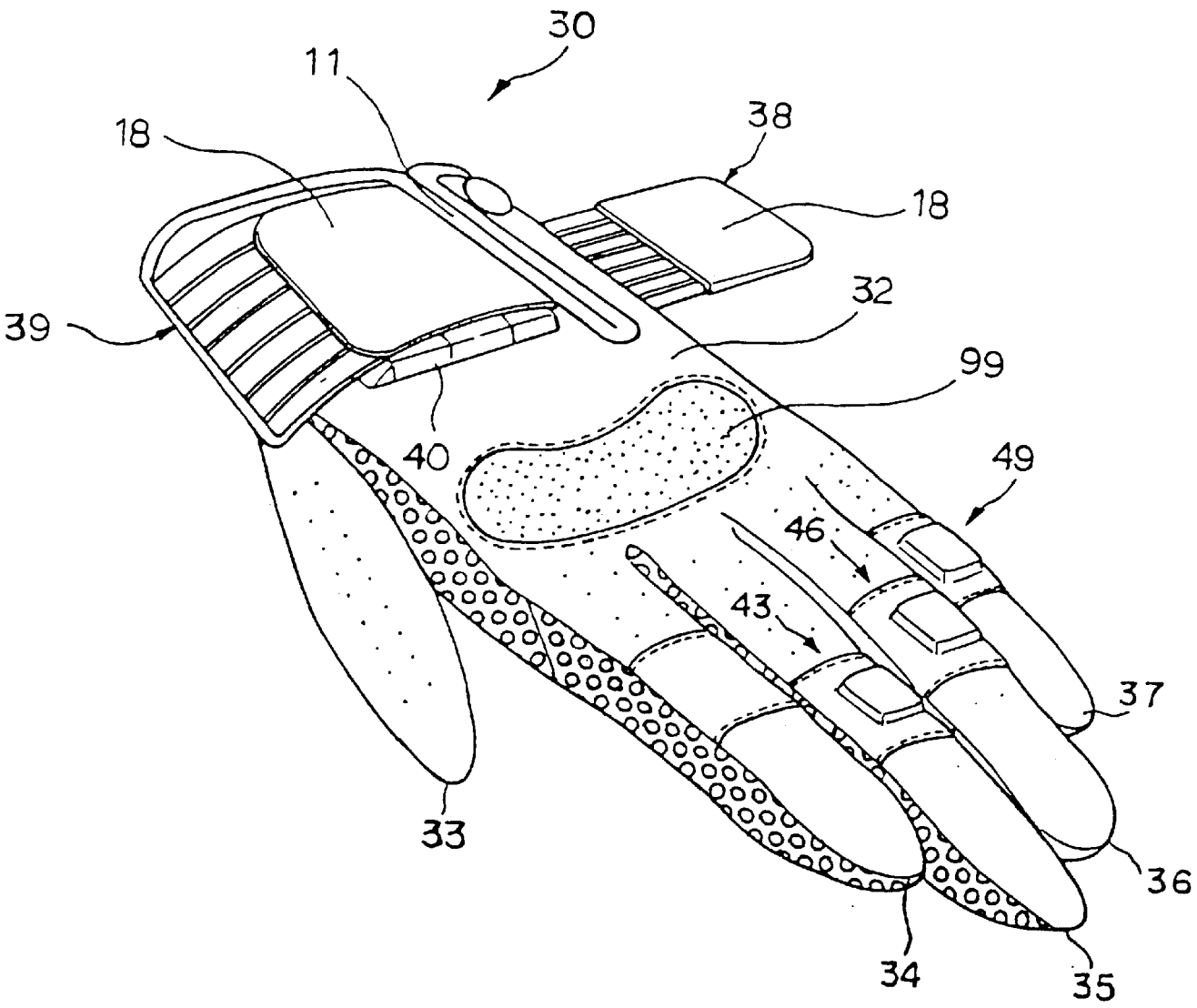
FIG. 7 is a perspective view of second embodiment of a golf glove.

The second embodiment of the present invention is represented in FIG. 7. On the glove surface of the back of the hand part 32, finger joint is equipped with open holes which penetrate the surface of the back of the hand part. A elastic rubber piece 99 is sewn to cover the hole.

When a hand is closed, bones at finger joint bulge. However, the elastic material fits well with hand bones' complicated movement and does not interfere with the natural feelings of the glove. When a hand grasps a golf club, the weight of the glove is distributed evenly to the whole glove centering the elastic material. This makes the swing stable. The elastic material can be substituted with some material which is elastic, like linen.

Hem of the wrist bands 38, 39 is sewn on the flank side of the palm of the hand part of glove 30. In the second embodiment, the other side hem of the wrist bands is sewn closed by a slit in the glove 30. That is, the hem of the first wrist band 39 is fixed on the surface of the back of the hand part and covers up the overlapped part 40 on the surface of the back of the hand part. The wrist bands 38, 39 work as tightening devices by pulling up the second wrist band 38 only and putting it onto the adhesive tape or velcro 18 of the first wrist band 39. It is possible to use only one hand in order to tighten up and cover up the overlapped part 40 on the surface of the back of the hand.

In the above embodiments, it is mentioned above that lead is used for the weights. However, the material is not limited to lead. It can be replaced with other kinds of material including iron, copper, magnet, etc. and two or more kinds of material can be mixed for use. Therefore, without changing the volume of the weights, they can be changed in weight depending on the wearer's skill and physical strength. When magnetic material including lead magnet is used, it improves blood circulation of wearer's hand.

In the above embodiments, it stated above that lead is used in the weight without treatment. However, such a method of using lead is not limited to the disclosed embodiment. Lead can be coated and plated.

Therefore, such treatment prevents lead, which is reported to be harmful to the human body, from being exposed directly to the surrounding environment.

Even when the material, like iron, which is relatively easy to get rust, is used, aforementioned coating treatment works to prevent rust.

In the above embodiments, the weight of the weight segments in not limited but is adjustable. For example, the purchaser of a glove weighing 30*g* can adjust the weight by changing the weight segments at the purchaser's preference. So, the glove purchaser has the ability to choose among gloves varying in weight by the purchaser's preference and physical strength.

In the above embodiments it is stated above that the place of the weights located on the glove surface, the second segment of the fingers, and the flank side of the second segment of the thumb. However, it is not limited to this location in the present invention. Therefore, it is possible to place them on the whole surface of the back of the hand part and also possible to place them only on the index finger part. The weights placed on the fingers may be placed on only on the segments of the fingers part but also possibly on whole surface of the back of the fingers.

Therefore the folding part of glove is distributed, accordingly the glove will not be heavy in part. Consequently, the feeling is good and the sense of the finger is not thick when the glove is worn.

In the present invention, the layer of the weights in the finger parts is not limited to the embodiment in which the folding part has one layer. Namely, the weights in the finger part can have more than two layers. Further the weights placed toward the wrist can have less than eight layers or more than ten layers, as well as nine layers.

In the above embodiments of the present invention, the weights can be attached and detached easily by the covering material. it might be possible to use a covering material equipped fastener to implement.

The present invention should not be limited to the above-described embodiment, and its improvement or alteration is possible within the scope of the invention stated.

What is claimed is:

1. A golf glove with a wrist end part, a hand part, a thumb part and finger parts, all of said parts having a back side and a palm side, said hand part having a first flank side, a second flank side and a slit adjacent to the second flank side, said golf glove comprising:

a group of mutually adjoining discrete weight segments affixed to the back side of the hand part at a position between the wrist end part and the thumb part; and a wrist band arranged and shaped such that when tightened, said wrist band can substantially surround said group of weight segments to hide them thereunder and to inhibit their movement.

2. The golf glove as recited in claim 1, wherein said wrist band includes a first band member fixedly secured to the first flank side of the hand part, a second band member fixedly attached to the second flank side of the hand part and a third band member fixedly affixed to the back side of the hand part in such a manner that said slit of the hand part is left between the second and the third band members and that the first and the second band members cooperate with each other to tighteningly hold said group of weight segments in place, said first through third band members being detachably attachable to one another.

3. The golf glove as recited in claim 1, wherein said group of weight segments collectively forming a substantially square pattern on said hand part and having little spacing therebetween.

4. The golf glove as recited in claim 1, further comprising independent weight segments each disposed on the back side of the finger parts.

5. The golf glove as recited in claim 1, wherein said hand part is provided with an elastic rubber piece on the back side thereof to ease flexing of fingers relative to a hand.

6. The golf glove as recited in claim 1, wherein said wrist band includes a first band member fixedly secured to the first flank side of the hand part and a second band member fixedly attached to the second flank side of the hand part, said first band member being detachably attachable to the second band member to thereby tighteningly hold said group of weight segments in place.

* * * * *